US006622754B1

(12) United States Patent
Roth et al.

(10) Patent No.: US 6,622,754 B1
(45) Date of Patent: Sep. 23, 2003

(54) LOAD-BASED DISHWASHING CYCLE

(75) Inventors: Ryan Kevin Roth, St. Joseph, MI (US); Stephen M. Groppel, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 103 days.

(21) Appl. No.: 10/025,935

(22) Filed: Dec. 19, 2001

(51) Int. Cl.[7] ..... B08B 3/10

(52) U.S. Cl. ..... 138/18; 134/25.2; 134/56 D; 134/57 D

(58) Field of Search ..... 134/10, 18, 25.2, 134/25.4, 30, 113, 57 D, 58 D, 56 D

(56) References Cited

U.S. PATENT DOCUMENTS

| | | | | | |
|---|---|---|---|---|---|
| 4,967,593 | A | | 11/1990 | McQueen | 73/295 |
| 5,006,767 | A | | 4/1991 | Maruyama et al. | 318/103 |
| 5,158,362 | A | | 10/1992 | Brauer et al. | 374/33 |
| 5,330,580 | A | | 7/1994 | Whipple, III et al. | 134/18 |
| 5,331,984 | A | * | 7/1994 | Isagawa | 134/57 D |
| 5,611,867 | A | * | 3/1997 | Cooper et al. | 134/18 |
| 5,669,983 | A | | 9/1997 | Cooper et al. | 134/18 |
| 5,792,276 | A | * | 8/1998 | Driessen | 134/18 |
| 5,797,409 | A | * | 8/1998 | Cooper et al. | 134/18 |
| 5,844,207 | A | | 12/1998 | Allard et al. | 219/497 |

OTHER PUBLICATIONS

Patent Abstracts of Japan, Publication No. JP4336023, Publication Date Nov. 24, 1992.

Patent Abstracts of Japan, Publication No. JP4367642, Publication Date Dec. 18, 1992.

Patent Abstracts of Japan, Publication No. JP5137691, Publication Date Jun. 1, 1993.

Patent Abstracts of Japan, Publication No. JP7059708, Publication Date Mar. 7, 1995.

* cited by examiner

*Primary Examiner*—Randy Gulakowski
*Assistant Examiner*—Saeed Chaudhry
(74) *Attorney, Agent, or Firm*—John F. Colligan; Robert O. Rice; Stephen Krefman

(57) ABSTRACT

A method of determining a dish load for an automatic dishwasher and a method of operating the automatic dishwasher based on the dish load. The dish load is determined by determining a first temperature corresponding to the temperature of the dishes, determining a second temperature corresponding to the temperature of a charge of water prior to a time when the charge of water contacts and transfers heat to the dishes, determining a third temperature corresponding to the temperature of the second charge of water when the temperature of the second charge of water and dishes have equalized, and calculating a temperature ratio of the difference between the second and third temperatures and the difference between the third and first temperatures.

39 Claims, 6 Drawing Sheets

LOAD-BASED DISHWASHING CYCLE

BACKGROUND OF THE INVENTION

1. Field of the Invention

The invention relates to a method for controlling the wash cycle of an automatic dishwasher. In one aspect, the invention relates to detecting the dish load in a dishwasher. In another aspect, the invention relates to the selecting of the steps and/or sub-cycles of the overall wash cycle in response to the detected dish load. In yet another aspect, the invention relates to adjusting the operating parameters, such as selecting the steps for the overall wash cycle and setting the variables for the steps based upon the size of the dish load.

2. Description of the Related Art

Domestic dishwashers are well known and have a general configuration regardless of the type of dishwasher, i.e. built-in, set-in, or stand-alone. The general configuration includes an open-faced tub, closable by a door, in which are mounted drawers and/or baskets for holding the dishes to be cleaned. A sump is located in the bottom of the tub along with a pump that circulates the water in the sump through a circulation system, generally comprising upper and lower sprayers, onto the dishes. A heating element is normally included to heat the water.

To clean the dishes, domestic dishwashers draw wash liquid from the sump at the bottom of the wash tub and spray the wash liquid within the wash tub to remove soil from dishes located on the baskets in the tub. The soil-entrained wash water is usually drained away. Large amounts of soil removed from the dishes and retained in the recirculating wash liquid can adversely impact the performance of the dishwasher. Therefore, an overall wash cycle may include multiple sequences or sub-cycles of the steps of water filling, circulating, and draining to adequately remove the soil. In some cases, the drain step is replaced with a step of filtering the soil from the water in combination with a partial drain and fill, which is referred to as a purge. The temperature of the water and the duration of the circulation are factors that control the soil removal. It is known to employ a system for adjusting the wash cycle duration and temperature in response to the level of soil in the wash liquid.

Dishwasher wash performance is also related to the size of the dish load, i.e. the number of dishes, in the wash chamber. All things being equal, large loads require longer wash cycles, higher temperature wash liquid, and more wash and rinse sub-cycles for a satisfactory level of cleaning. Smaller loads require shorter wash cycles, lower temperature wash liquid, and fewer wash and rinse sub-cycles.

Without any other constraints, all wash cycles could be conducted based on a "worst-case" approach: a full load of dishes with a high soil content. This would ensure that the dishes were adequately cleaned every time. However, increasing energy costs and increasing environmental awareness dictate that the energy used and water consumed be no greater than that needed to clean the dishes and thereby avoid wasting resources.

While there are presently many different methods for determining the soil content, the same cannot be said for determining the size of the dish load. Presently, selecting a wash and rinse cycle appropriate to the dish load is typically done by selecting one of a limited number of standardized cycles based on an estimate of the extent to which the selected cycle accurately corresponds to the actual dish load.

If the standardized cycle does not accurately represent the actual dish load and soil load, the wash liquid temperature may be too low or unnecessarily high, or the wash cycle duration may be too short or unnecessarily long. For example, heavily soiled dishes may not be washed in sufficiently hot water because a large wash cycle has not been selected, resulting in a poor wash performance. In other circumstances, dishes which are relatively lightly soiled and do not require as high a wash liquid temperature may nevertheless be washed in relatively hot wash liquid because a large wash cycle was selected. For example, lightly soiled dishes may be washed too long or there may be more water changes than necessary if a large load is indicated, which can result in unnecessary energy usage.

Accordingly, there is a need for a dishwasher wash system that can automatically adjust the temperature and duration of the wash cycle, the number of rinses, and the duration of the rinses in response to the dish soil level and dish load size.

SUMMARY OF THE INVENTION

In one aspect, the invention relates to a method of determining a dish load in an automatic dishwasher comprising a tub for receiving dishes to be cleaned, a water inlet valve for introducing water into the tub, a spraying assembly for spraying the water throughout the tub to clean the dishes, a heating element for heating the water, a temperature sensor for sensing the temperature of the water, and a controller. The controller is operably coupled to and controls the operation of the water inlet valve, spray assembly, heating element, and temperature sensor to introduce water into the tub, spray the water, and drain the water to wash the dishes according to a wash cycle stored in the controller.

The method comprises introducing a first charge of water into the tub and spraying the first charge of water throughout the tub. A first temperature is determined corresponding to the temperature of the first charge of water when the temperature of the first charge of water and dishes are substantially equalized. The first charge of water is then removed from the tub. A second charge of water is introduced into the tub. A second temperature is determined that corresponds to the temperature of the second charge of water prior to a time when the second charge of water contacts and transfers heat to the dishes. The second charge of water is sprayed throughout the tub. A third temperature, corresponding to the temperature of the second charge of water when the temperature of the first charge of water and dishes are substantially equalized, is then determined. The dish load is determined by calculating a temperature ratio of the difference between the second and third temperatures and the difference between the third and first temperatures.

Preferably, the determination of the second temperature occurs after the initiation of the introduction of the second charge of water. The determination of the second temperature can be delayed for a predetermined time after the initiation of the introduction of the second charge of water. The determination of the second temperature is preferably done prior to the spraying of the second charge. The determination of the second temperature can be accomplished by setting the second temperature equal to the maximum temperature sensed by the sensor within a predetermined time after the initiation of the introduction of the second water charge.

The determination of the dish load can include comparing the temperature ratio to a predetermined threshold value and selecting a dish load based on the comparison.

Preferably, the selection of the dish load comprises selecting the dish load from a group of dish load categories such as, for example, a group comprising at least large and small categories.

The threshold value is preferably selected based on at least one physical characteristic of the dishwasher such as, for example, the material from which the tub is made.

In another aspect, the invention relates to a method for cleaning dishes based on the dish load in an automatic dishwasher. The automatic dishwasher comprises a tub for receiving dishes to be cleaned, a water inlet valve for introducing water into the tub, a spraying assembly for spraying the water throughout the tub to clean the dishes, a heating element for heating the water, a temperature sensor for sensing the temperature of the water, and a programable controller. The controller is operably coupled to and controls the operation of the water inlet valve, spray assembly, heating element, and temperature sensor to wash the dishes according to a wash cycle programmed into the controller. The wash cycle has operating parameters that include the steps of the wash cycle and operating variables for the steps.

The method comprises introducing a first charge of water into the tub and spraying the first charge of water throughout the tub. A first temperature is determined corresponding to the temperature of the first charge of water when the temperature of the first charge of water and dishes are substantially equalized. The first charge of water is then removed from the tub. A second charge of water is introduced into the tub. A second temperature is determined that corresponds to the temperature of the second charge of water prior to a time when the second charge of water contacts and transfers heat to the dishes. The second charge of water is sprayed throughout the tub. A third temperature, corresponding to the temperature of the second charge of water when the temperature of the first charge of water and dishes are substantially equalized, is then determined. The dish load is determined by calculating a temperature ratio of the difference between the second and third temperatures and the difference between the third and first temperatures. At least one operating parameter for the wash cycle is set based on the dish load.

Preferably, the setting of the operating parameter comprises selecting a step for the wash cycle, which can include selecting at least one of a water fill step, a water spraying step, a water removing step, and a water heating step.

The setting of at least one parameter can further comprise setting a variable for the selected step. It is preferred that the variable be at least one of the duration and water temperature for the selected step.

The method can further comprise determining a soil load and using the dish load and soil load to set the at least one operating parameter. In setting the operating parameter, the dish load and soil load can be compared to a predetermined threshold value, and selecting the step and setting the variable is based on the comparison.

The setting of the at least one parameter can comprise the setting of a variable for a step of the wash cycle. Preferably, the variable is at least one of the duration and water temperature for a step of the wash cycle. The setting of the at least one parameter can also comprise the selecting of a step for the wash cycle and setting a variable for the selected step or for another step of the wash cycle.

Preferably, the dish load is compared to a predetermined threshold value and the setting of the operating parameter is based on the comparison.

In yet another aspect, the invention relates to a method for cleaning dishes based on the dish load in an automatic dishwasher comprising a tub for receiving dishes to be cleaned, a water inlet valve for introducing water into the tub, a spraying assembly for spraying the water throughout the tub to clean the dishes, a heating element for heating the water, a temperature sensor for sensing the temperature of the water. A programmable controller is operably coupled to and controls the operation of the water inlet valve, spray assembly, heating element, and temperature sensor to wash the dishes according to a wash cycle programmed into the controller. The wash cycle generally comprises operating parameters including the steps of the wash cycle and operating variables for the steps.

The method comprises three temperature determinations: determining a first temperature corresponding to the temperature of the dishes, determining a second temperature corresponding to the temperature of water in the tub; and determining a third temperature corresponding to the temperature of the dishes after the temperature of the water and dishes are substantially equalized in response to the spraying of the water throughout the tub. A dish load is then determined by calculating a temperature ratio of the difference between the second and third temperatures and the difference between the third and first temperatures. The dish load is then used to set at least one operating parameter for the wash cycle based on the dish load.

DESCRIPTION OF THE PREFERRED EMBODIMENT

Figure 1:
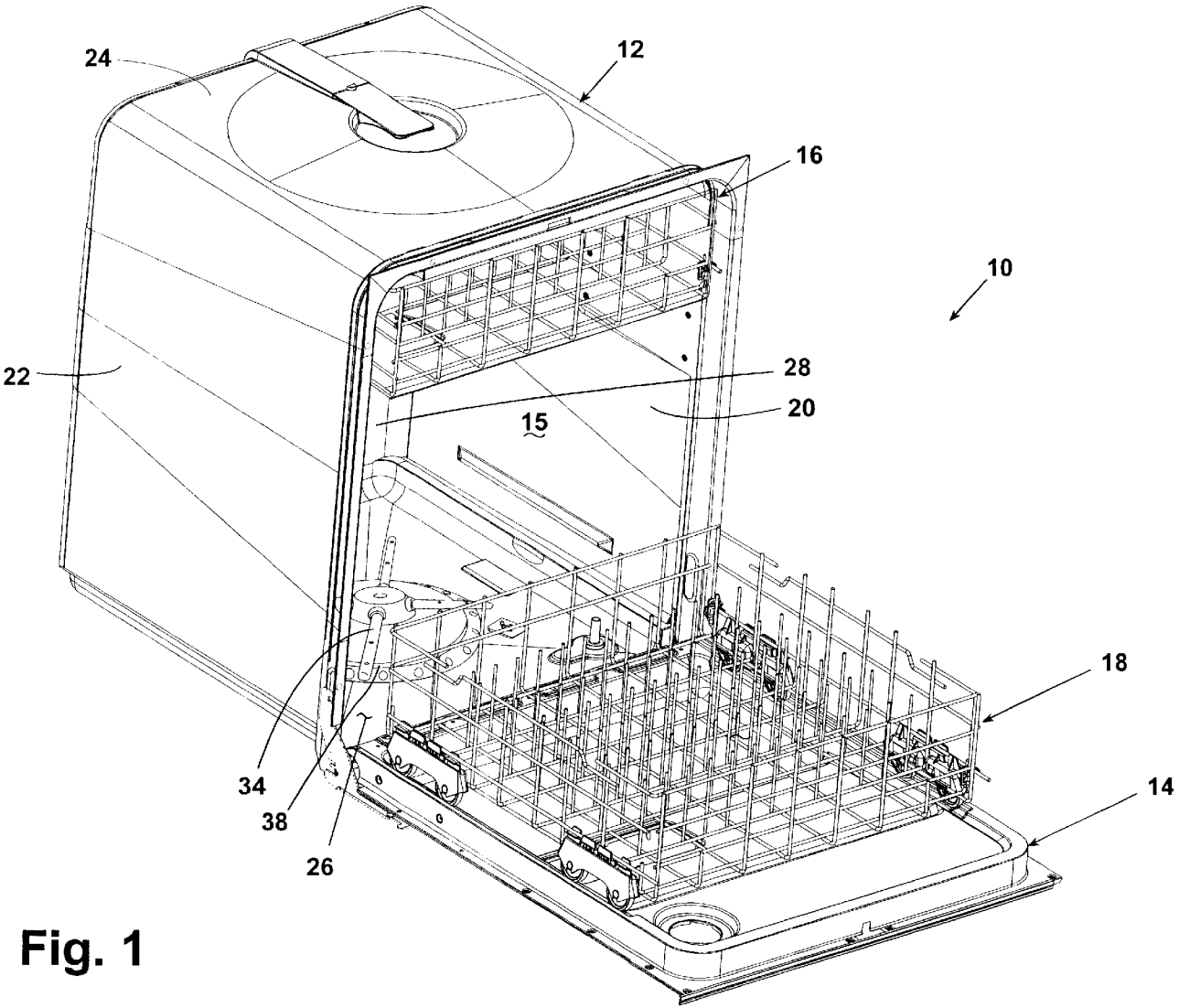
FIG. 1 is a perspective view of an in-cabinet dishwasher for cleaning soiled dishes according to the invention.

FIG. 1 illustrates a conventional in-cabinet automatic dishwasher 10 well-known in the art comprising an open-faced tub 12 having side walls 20, 22, whose upper and lower ends are connected by a top wall 24 and a bottom wall 26, respectively, and all of which extend away from a rear wall 28. The walls of the tub 12 define a washing chamber 15. A door 14 is hingedly mounted to the tub 12 for movement between an open position (shown), where the door 14 is generally horizontal, to a closed position, where the door 14 is vertical and seals the washing chamber 15. The dishwasher 10 is provided with an upper rack 16 and a lower rack 18, both of which are received within the washing chamber 15 during the operation of the dishwasher 10 and are extendable outwardly of the washing chamber 15 for ease in loading and unloading dishes carried by the racks 16, 18. The upper rack 16 is shown in the operating position and the lower rack 18 is shown in the loading/unloading position.

It should be noted that the dishwasher shown in FIG. 1 is a built-in type designed to be mounted within a cabinet system and does not have an external or decorative housing. The invention as described herein applies to all types of automatic dishwashers regardless of the particular type.

Figure 2:
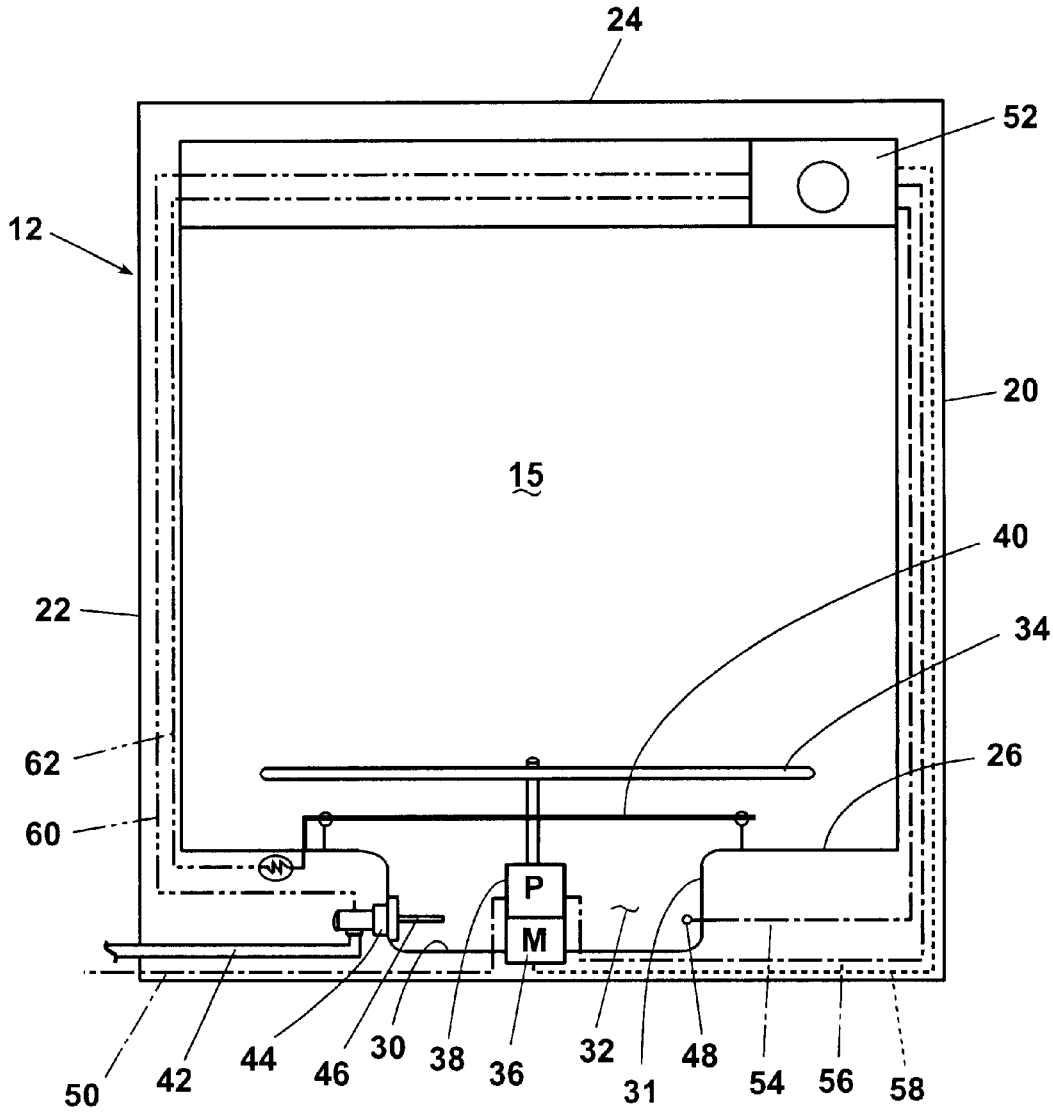
FIG. 2 is a schematic of the dishwasher of FIG. 1 showing the dishwasher components used in the invention.

Referring to FIG. 2 specifically and FIG. 1 generally, the bottom floor 26 has a sump 32 in the center thereof, defined by a downwardly-extending side wall 31 transitioning to a sump floor 30. A sprayer assembly 34 along with a motor 36 and pump 38 are disposed within the sump 32, with the sprayer assembly extending above the surface of the bottom wall 26. The sprayer assembly 34 sprays wash liquid on soiled dishes during operation of the dishwasher 10 and is operably coupled with the pump 38 for pumping wash liquid through the sprayer 34.

A heating element 40 is located in the tub, preferably between the sump and the sprayer assembly 34.

Water control to and from the tub 12 is provided by a water inlet 46 located in the sump 32 and fluidly coupled to an inlet valve 44, which is connected to an external water supply. Actuation of the valve 44 controls the introduction of water into the sump 32 through the inlet 46. A drain 50 is fluidly connected to the pump 38 and permits the pump 38 to expel the wash water from the sump 32. Although not illustrated, the drain function can also be performed by a separate drain pump fluidly connected to the pump and/or the sump.

A temperature sensor 48, preferably a thermistor, for determining the temperature of the wash liquid is also located in the sump 32. Although the temperature sensor 48 is preferably a thermistor, any suitable temperature sensor can be used.

The operation of the dishwasher is controlled by a microprocessor-based control assembly 52, which has electrical leads 54, 56, 58, 60, 62, that couple the thermistor 48, motor 36, a pressure sensor (not shown) in the pump 38, inlet valve 44, and heating element 40 thereto. The pressure sensor in the pump 38 is used for determining the soil load. Although soil detection is preferably done with a pressure sensor, there are many other well known soil detection devices and methods. Any suitable soil detection can be used.

The dishwasher 10 can process the dishes through several common cycles in a sequence well-known in the art. Most common cycles are comprised of a basic sub-cycle having the steps of fill, spray, and drain. These steps are intuitive. The fill step includes introducing water into the wash tub 12, typically into the sump 32 with the valve 44. The spray step sprays the water onto the dishes by using the spray assembly 34. The spray step generally comprises the recirculating of the water in that the water sprayed by the spray assembly will naturally flow into the sump 30 after spraying where the pump 38 will once again send the water to the spray assembly 34. The drain step comprises removing the water from the wash tub 12.

Depending on the selected or desired operating cycle, the duration of each of the fill, spray, or drain cycles can be adjusted or altered. For example, if it is desired to soak the dishes, which is useful in the case of hardened soil loads, a spray step can be initiated for a selected duration, after which the spraying is paused for a time period to let the water soak the soil. Upon the completion of the delay, the spray step can be restarted or a new cycle initiated.

The temperature of the water can also be adjusted as part of any cycle by turning on the heating element 34. Typically, the temperature is adjusted during the fill or spraying steps since there is little value in heating water that is being drained. The temperature is normally increased in response to increasing soil loads.

A typical wash cycle for the automatic dishwasher 10 comprises multiple sub-cycles including, in sequence, a prewash cycle, a main wash cycle, a rinse cycle, and a dry cycle. The prewash cycle comprises fill, spray, and drain steps. The prewash cycle can include the addition of detergent to the water. The use of detergent during the prewash cycle is generally reserved for greater soil loads. The wash cycle also includes fill, spray, and drain steps. Detergent is usually introduced into the water used during the wash cycle. The rinse cycle usually comprises one or more iterations of the fill, spray, and drain steps to ensure that the detergent is removed from the dishes. A purge step is often incorporated into the rinse cycle. The purge step uses the clean water of the rinse cycle to purge any soil or detergent residue from the pump. The dry cycle is typically a heated cycle in which the heating element is actuated as needed to decrease the time needed to dry the dishes. However, the drying step can be accomplished without activating the heating element so that the dishes are left to dry naturally after the completion of the rinse cycle.

Other traditional cycles include a sanitation cycle, a pots and pans cycle, a china cycle, and a rinse only cycle. The sanitation cycle includes very high temperature water for killing bacteria. The pots and pans cycle includes a long pre-soak cycle along with heated water to remove a heavy soil load from cooking dishes. The china cycle includes shortened wash and rinse cycles at lower water temperatures. The rinse only cycle includes fill, spray, and drain steps, generally without detergent.

Soil load may be determined during the prewash and wash cycles in a conventional manner well-known in the art. Soil load can be determined through the use of an optical sensor measuring the soil load in the wash liquid, or by a pressure transducer which measures the pressure developed within a soil collection area having a filter screen which can be formed as part of the pump 38. An example of a suitable soil load sensor is described in U.S. Pat. No. 5,803,100, which is incorporated by reference.

The soil load comprises a variable in the formula discussed hereinafter for obtaining proper cleaning of the dishes. All things being equal, a higher soil load will require higher water temperatures, and/or longer or multiple spray steps to obtain the same level of cleaning.

The dish load, i.e. the mass of the dishes in the tub 12, is another variable for obtaining the proper level of cleaning. All things being equal, a higher dish load will require higher water temperatures, and/or longer or multiple spray steps to obtain the same level of cleaning.

The invention is an improvement over prior wash cycles in that it more accurately determines the dish load. The accurate dish load value, when used alone or in combination with the soil load, permits discrete or continuous adjustments of the operation parameters for the steps of the various cycles and/or the selection of certain sub-cycles comprising the wash cycle.

The adjustment of the wash and rinse cycles is based upon the concept that large loads of heavily soiled dishes require a longer wash cycle with higher temperature wash liquid and additional rinse cycles of longer duration for a satisfactory cleaning. Conversely small loads of lightly soiled dishes require a shorter wash cycle with a lower temperature wash liquid and fewer rinse cycles of shorter duration.

The dish load determination is based upon the energy balance principle that the total heat energy of the liquid, the dish washing tub, and the dishes in the dishwasher remains constant despite heat transfer from the liquid to the tub and the dishes, and is quantified by the following well-known thermodynamic relationship:

$$Q=mc\Delta T$$

where

Q=the quantity of heat transferred to a body, m=the mass of the body, c=the specific heat of the body, and ΔT=the change in temperature of the body due to the heat transfer.

For the dishwasher system, the heat balance becomes $$Q_{dishes}+Q_{tub}=Q_{water}, \text{ or}$$

$$mc\Delta T_{dishes}+mc\Delta T_{tub}=mc\Delta T_{water}.$$

Thus, the change in temperature of the liquid, the dish washing tub and the dishes can be determined and is used to determine the size (i.e. the mass) of the dish load.

While the equation appears simple, it is practically very difficult to directly obtain these changes in temperature, especially for the dishes. For example, it is difficult to have a sensor that is capable of being located in the automatic dishwasher that can accurately measure the temperature of the dishes and do so without interfering with the operation of the dishwasher. In the automatic dishwasher art, this problem is exacerbated because of the very strong market pressure against any substantial price increase. Thus, the solution to what appears to be a simple equation must be: accurate, cost effective, and not interfere with the operation of the dishwasher.

If it is assumed that $\Delta T_{dishes}=\Delta T_{tub}$, then the heat balance equation is simplified to equivalent ratios for the temperature changes and the mass:

$$\frac{\Delta T_{dishes}}{\Delta T_{water}}=\frac{mc_{water}}{(mc_{dishes}+mc_{tub})}$$

The values for $mc_{water}$ and $mc_{tub}$ are known and are relatively constant for a given dishwasher. The temperature of the water is easily determined by direct measurement. Therefore, if the change in temperature of the dishes can be determined, the above equation can easily be solved for the value of $mc_{dishes}$, which is representative of the dish load. However, given the assumption that $\Delta T_{dishes}=\Delta T_{tub}$, the change in temperature of the dishes must be determined when it is equal to the change in temperature of the tub. Such a condition will exist as part of any spray step where the spray step has lasted a sufficient time for the temperature of the water, dishes, and tub to equalize. So, for example, the water temperature at the end of a sufficiently long pre-wash equals the starting temperature of the dishes going into the main wash.

The preferred approach according to the invention involves measuring the temperature of the liquid in the dishwasher at selected intervals during the prewash and main wash cycles and calculating a "T ratio" from the temperature values according to the following equation:

$$T \text{ ratio}=(T_w-T_f)/(T_f-T_d)$$

where $\Delta T_{water}=T_w-T_f$ $\Delta T_{dishes}=T_f-T_d$ $T_d$=the temperature of the washing liquid after the equalization of the temperature for the water, dishes, and tub during the prewash cycle, ° F.

$T_w$=the temperature of the washing liquid at the initiation of the wash cycle, ° F., and $T_f$=the temperature of the washing liquid after the equalization of the temperature for the water, dishes, and tub during the wash cycle, ° F.

All temperature determinations are based upon the output of the thermistor 48. It has been determined that the maximum output of the thermistor 48, and thus the maximum temperature measured by the thermistor 48, lags the sensing of the temperature by a short period of time. Thus, during each temperature reading interval, the thermistor is monitored over a selected time interval to ensure that the maximum temperature value has been accurately determined.

The controller 52 then determines a value of "T ratio" based upon the temperature values determined as described above.

The invention is capable of resolving the dish load value with a high degree of accuracy. Thus, it is possible to use the T ratio to precisely control the parameters of the steps in the wash cycle and/or the selection of the sub-cycles to ensure that only minimum amounts of energy and water are used to satisfactorily clean the dishes.

The accuracy of the T ratio is dependent on the data collected. There can be several sources of variation that can affect the accuracy of the T ratio. Some of the major sources of variation include the water temperature measurement, the water volume supplied, and the loss of energy from the system.

Almost all temperature sensors are limited in their precision, which impacts the ability of the sensor to consistently provide an accurate reading. It was discovered that the thermistor has a lag in the time from when the thermistor is exposed to a temperature change, such as the introduction of water into the sump, to when the temperature is accurately read. Thus, for the thermistor, it is preferred to monitor the temperature for a certain time after the introduction of the water and treat the highest temperature measured as the initial temperature of the water.

The accuracy of the water volume is dependent on the precision of the valve. Valves are typically designed for a given flow rate. If a certain water volume is required, the valve is left open for an amount of time that will produce the desired volume. The valve, like the temperature sensor, has limits on its precision. The valve is also dependent on the pressure of the water source supply to the valve. If the source pressure is not within the required range, the source may not supply water to the valve fast enough to meet the designed flow rate. Water could be measured and compensated for but then the accuracy of the measurement can become a possible source of error.

The basis for the T ratio assumes that the heat into the system equals the heat out of the system. Most dishwashers are insulated to minimize the heat loss. To the extent heat is lost, the heat loss is well known and can be factored into the determination of the T ratio. However, in most situations, the heat loss is determined for a standard environment, including an ambient temperature. If the environment is not within the standard environment or the dishwasher is installed in such a way that the insulation is not effective, then the heat loss will be greater than assumed, leading to an inaccurate determination of the T ratio.

These variations should be minimized or compensated for to obtain useful results. The degree to which the accuracy must be maintained will depend on the intended use of the data. It is possible to make an automatic dishwasher with the appropriate sensors such that a very accurate T ratio can be calculated. Very accurate data can be used to resolve whether 7 or 8 plates are in the dishwasher, for example. However, many practical and cost considerations, especially in the home appliance marketplace, are a bar to such a use of the method. The additional cost of almost perfect insulation, more precise sensors, and/or additional sensors (a volume sensor to check the volume of the water dispensed by the valve), would result in an appliance that might not be cost competitive and might cost more than the savings attributable to the cost saved in water and energy consumption.

Furthermore, most households do not need such accuracy. A great deal of the reduced resource consumption can be obtained merely by knowing if the dish load is above or below a certain threshold value. It is common for some users to run the dishwasher only when the dishwasher is full whereas other users run the dishwasher after every meal, which is usually a much smaller dish load than the full dish load. Thus, the threshold value can be a value that distinguishes between these two common usage patterns. This usage pattern can be thought of as determining the difference between a large and a small dish load. Of course, if finer resolution is required, multiple threshold values could be determined, say for small, medium, and large dish loads.

The preferred approach for the method according to the invention is to use a single threshold value that corresponds to the difference between a large and a small load. This threshold value, "k", is preferably determined by testing, but can be determined analytically for a given machine. The calculated T ratio is compared to "k" to determine if the load is large or small.

For most contemporary dishwashers, the tub is made from either plastic or stainless steel. Since the tub mass and its specific heat are a function of the type of material from which the tub is made, the controller 52 preferably calculates a value of "k" based upon the dishwasher tub material (plastic or stainless steel). The "k" value can also be used to compensate for heat loss from the system, which is related to the temperature $T_w$. Preferably, the k value is determined as follows:

$$k_{pl}=0.085+0.0073T_w$$

where $k_{pl}$ is the value of "k" for a plastic tub, or $$k_{ss}=0.405+0.0041T_w$$

where $k_{ss}$ is the value of "k" for a stainless steel tub.

The controller 52 then compares the calculated "T ratio" with the calculated value of k. If "T ratio" is greater than k, the dish load is a large dish load, generally comparable to a 12-place setting. If "T ratio" is less than k, the dish load is a small dish load, generally comparable to a 4-place setting. The determination of the dish load size is preferably performed during the main wash cycle immediately after the determination of $T_f$. This determination, along with the soil load determination, is used by the controller 52 to adjust the main wash cycle and the rinse cycles.

Prior to the determination of the dish load size, the controller 52 assumes by default that the dish load is a 12-place setting. The controller will also assume that the dish load is a 12-place setting under any of the following potential circumstances that affect the confidence in the calculated T ratio:

calculation of a T ratio less than 0.5, which generally indicates an empty dishwasher, if the dishwasher door was opened or power to the dishwasher was interrupted between the initiation of the determination of $T_d$ and the calculation of T ratio, upon completing or aborting the current cycle, if $T_d$, $T_w$, or $T_f$ are out of the temperature range for the thermistor, if $T_f-T_d=0$, which would involve division by 0 for the calculation of T ratio, or if $T_w-T_d$ is less than 8, which for the preferred embodiment is indicative that the temperature measurement error is too significant relative to such small changes in temperature.

Figure 3:
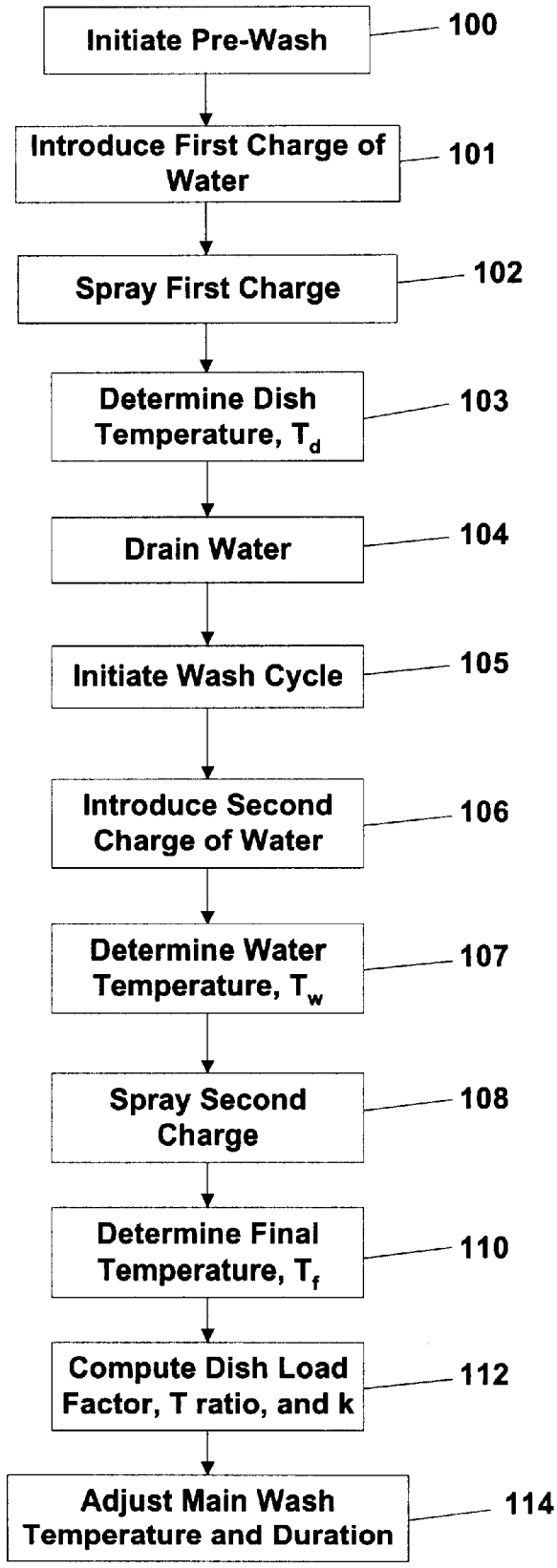
FIG. 3 is a flowchart of the steps of a Pre-Wash Cycle and a Main Wash Cycle comprising the determination of the dish load and soil load according to the invention.

A preferred wash cycle according to the invention is shown in FIG. 3. The dish washing process begins with the initiation of the pre-wash cycle 100. This includes the step 101 of introducing a first charge of water into the tub 12, and the step 102 of spraying the first charge of water over the dishes. If a soil load determination is made, it is typically made during the spraying of the first charge of water in step 102. At the end of the pre-wash cycle, the dish temperature $T_d$ is determined by the thermistor 48 during the dish temperature determination step 103. The pre-wash cycle is then concluded by the removal of the first charge of water in the drain step 104.

Preferably, $T_d$ is determined at the end of the spraying step of the pre-wash cycle. It is worth noting that $T_d$ can be taken at any time during the spraying step once the temperature of the water, dishes, and tub have equalized since the equalization can occur prior to the end of the spraying step and the continued operation of the spraying step can improve the accuracy of the measurement.

Regardless of the determination methodology, the value of $T_d$ is stored in the controller 52. This is followed by initiation of the main wash cycle 105 and the step 106 of introducing a second charge of water into the tub 12. At the beginning of the main wash cycle, prior to when the second charge of water contacts the dishes and transfers heat, the water temperature $T_w$ is determined by the thermistor 48 during the water temperature determination step 107, and this value is sent to the controller 52. The second wash charge is then sprayed over the dishes in the second charge wash step 108. Preferably, the determination of the temperature $T_w$ is done during or after the completion of the introduction of a charge of water into the tub 12. If the thermistor 48 is used to sense the water temperature, the water temperature will be monitored over time and the maximum temperature will be used as $T_w$ to account for the inherent lag between the actual temperature and the temperature sensed by the thermistor 48. The maximum temperature is used since the water temperature is almost always higher than the tub and dish temperature at the end of a non-heated pre-wash.

The main wash is continued by spraying the second charge throughout the tub 108 for a suitable period of time, preferably 3 minutes, followed by the determination of the final temperature $T_f$ by the thermistor 48 during the final temperature determination step 110. A signal indicative of the value $T_f$ is sent to the controller 52, the controller 52 then calculates T ratio and "k" during the computation step 112, and determines the dish load. The dish load and soil load, if used, are then used to adjust the main wash temperature and duration during the adjustment step 114. The controller 52 uses the soil load and dish load to set the operational parameters for the remainder of the cycle.

Figure 4:
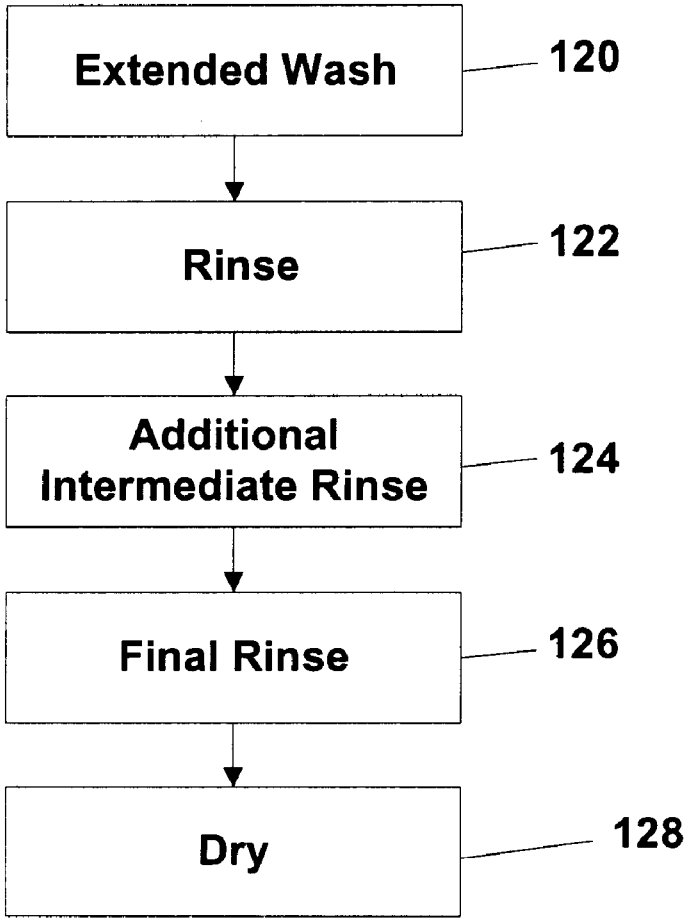
FIG. 4 is a flowchart of a first alternate sub-cycle for the Main Wash Cycle and Rinse Cycles, which includes modified wash and rinse cycles for a heavily soiled large dish load as determined according to the invention.
Figure 5:
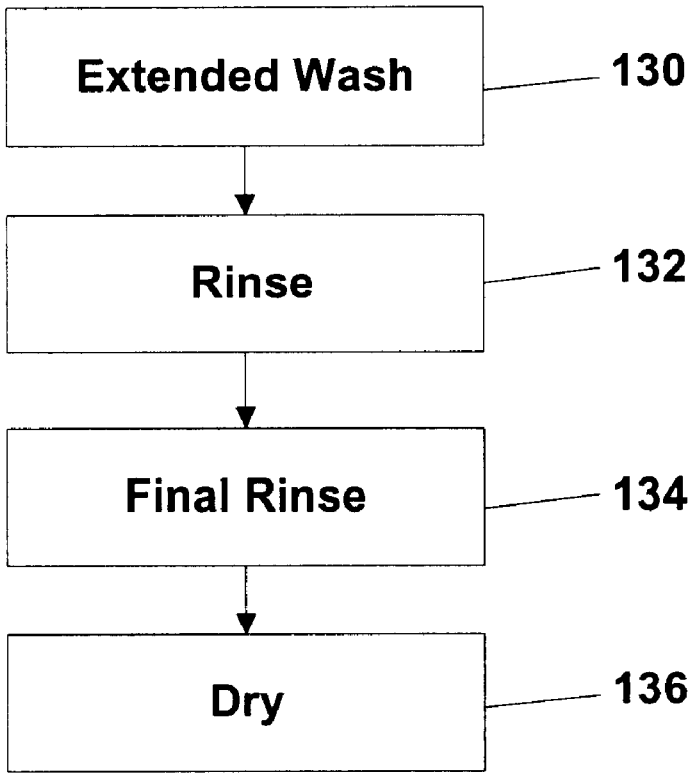
FIG. 5 is a flowchart of a second alternate sub-cycle for the Main Wash Cycle and Rinse Cycles, which includes modified wash and rinse cycles for a heavily soiled small dish load and a lightly soiled larger dish load as determined according to the invention.
Figure 6:
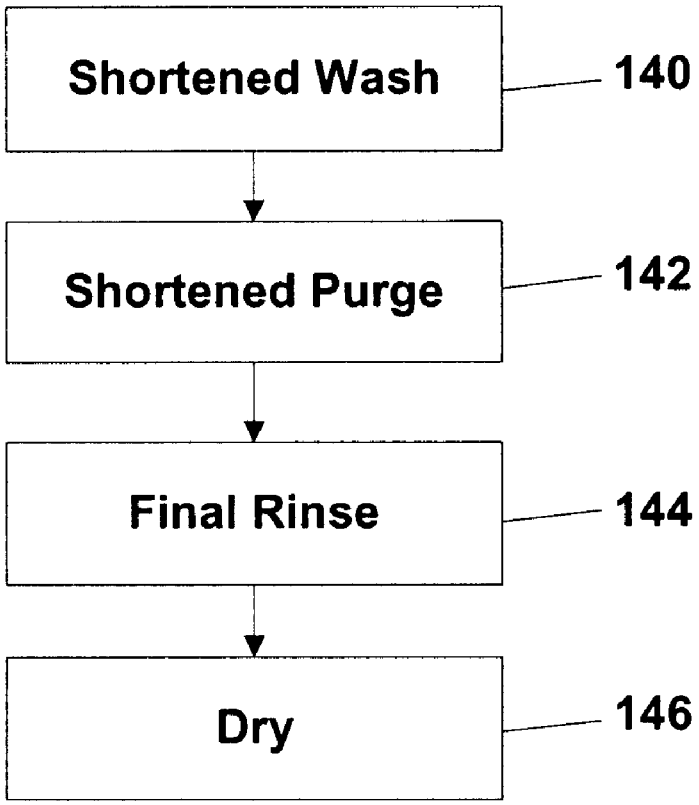
FIG. 6 is a flowchart of a third alternate sub-cycle for the Main Wash Cycle and Rinse Cycles, which includes modified wash and rinse cycles for a lightly soiled small dish load as determined according to the invention.

FIGS. 4–6 illustrate the preferred settings adjustments for the operational parameters of the wash cycle depending on the determined soil and dish loads. In general, the adjustments relate to three conditions of dish load and soil load.

FIG. 4 illustrates the cycle steps for a large dish load and a large soil load condition. FIG. 5 illustrates the cycle steps for a large dish load and light soil load condition, and also for a light dish load and large soil load condition. FIG. 6 illustrates the wash and rinse cycles for a light dish load and light soil load condition.

As illustrated in FIG. 4, if the controller 52 determines that the dishwasher 10 contains a large dish load and large soil load, an extended main wash cycle 120 is selected to continue the wash cycle. The water is sprayed and heated to 140° F., and the wash cycle continues for 20 minutes. This is followed by a two-minute drain step to remove the wash liquid from the tub 12. This is followed by a rinse cycle 122, instead of a purge cycle, in which the tub 12 is again charged with water, followed by a 6-minute spray and soil removal step, and a two-minute drain step. Another charge of water is added to the tub 12 to initiate an additional intermediate rinse cycle 124. During this cycle, the liquid is sprayed over the dishes during a 4-minute spray step, followed by a two-minute drain step. A final rinse cycle 126 is initiated with a liquid charge step to again charge the tub 12 with rinse water. The liquid is sprayed and heated to 140° F., and sprayed over the dishes during a spray step for 7 minutes. This is followed by a drain step, and a dry cycle 128.

As illustrated in FIG. 5, if the controller 52 determines that the dishwasher 10 contains either a large dish load and light soil load or a light dish load and large soil load, an extended wash cycle 130 is selected. This comprises spraying and heating the washing liquid to a temperature of 130° F. and continuing the wash cycle for 20 minutes, followed by a two-minute drain step. A rinse cycle 132, instead of a purge cycle, is initiated by introducing a charge of water into the tub 12, followed by a 6-minute spray step, and a two-minute drain step. A final rinse cycle 134 at 140° F. is initiated by a charge of water introduced into the tub 12, spraying and heating of the liquid to 140° F., followed by a 7-minute spray step, a two-minute drain step, and a dry cycle 136. An intermediate rinse cycle is not used.

As illustrated in FIG. 6, if the controller 52 determines that the dishwasher 10 contains a light dish load and light soil load, a shortened wash cycle 140 is selected. The liquid is sprayed and heated to 120° F., then pauses to soak for 4 minutes, and then sprays the dishes for a 4-minute spray step. This is followed by a two-minute drain step. A purge cycle 142, instead of a rinse cycle, comprises a one-minute fill and spray step, followed by a one-minute drain step. A final rinse cycle 144 is initiated by filling the tub 12 with a charge of water, spraying and heating the water to 140° F., and spraying the water over the dishes for 7 minutes, followed by a drain step, and a dry cycle 146.

The following table summarizes the cycle times for the remaining main wash, purge and rinse, and intermediate rinse cycles for each dish load and soil load condition for the preferred embodiment disclosed herein.

TABLE 1

CYCLE TIMES FOR SELECTED DISH LOADS AND SOIL LOADS

| Cycle | Main Wash Time, min:sec | Purge/Rinse Time, min:sec | Intermediate Rinse Time, min:sec |
|---|---|---|---|
| High Load/High Soil | 22:00 | 9:35 | 7:35 |
| High Load/Low Soil | 22:00 | 9:35 | N/A |
| Low Load/High Soil | 22:00 | 9:35 | N/A |
| Low Load/Low Soil | 10:00 | 2:00 | N/A |

The temperature of the washing liquid is also adjusted by the controller 52 based upon the dish load and soil load condition as described herein. After the determination of a large dish load/high soil load condition, the washing liquid is sprayed and heated to 140° F. for the remainder of the main wash. After the determination of a large dish load/light soil load condition or a light dish load/large soil load condition, the washing liquid is sprayed and heated to 130° F. for the remainder of the main wash. After the determination of a light dish load/light soil load condition, the washing liquid is sprayed and heated to 120° F. for the remainder of the main wash.

The automatic determination of the dish load described herein removes the uncertainty associated with selecting a preset washing and rinsing cycle based upon standardized assumptions about the dish load and soil load. The wash and rinse cycles will be more closely tailored to the actual dish load and soil loads. Consequently, a large load of heavily soiled dishes will be satisfactorily cleaned. Conversely only that volume of heated water needed for a lightly soiled small load will be used, resulting in energy savings.

While the invention has been specifically described in connection with certain specific embodiments thereof, it is to be understood that this is by way of illustration and not of limitation, and the scope of the appended claims should be construed as broadly as the prior art will permit. For example, while it is preferred that $T_d$ and $T_w$ be taken from different charges of water, it is possible for the same charge of water to be used. The charge of water can be left as is for the wash cycle or prepared for the wash cycle. Preparation of the water charge could include heating the water and/or removing soil from the water. The heating of the water would preferably be done without spraying the water so that most of the heat from the heating element is directed into the water.

The determination of the T ratio is preferably made in the context of the pre-wash and wash cycles since this conforms with already existing cycle steps. However, it is within the scope of the invention for this determination to be made at any other suitable time. It is within the scope of the invention to have a special cycle just for determining the dish load. The special cycle only need determine $T_d$ and $T_f$ at a time when the water temperature equals the dish temperature. The taking of $T_w$ can occur at the introduction of the second charge of water or after the first charge of water is treated for a second use.

The various alternative cycles shown are the preferred cycles for the current application where the dish load is used in combination with the soil load and only the distinction between a large load and a small load is desired. If the dish load determination of the invention is used in other applications, the types of cycles selected, the steps of each of the cycles, and the variables of each of the steps can be different from and most likely will be different from those shown in FIGS. 4–6. The cycles of FIGS. 4–6 are illustrative of one way in which the dish load data can be used and are not limiting to the invention.

What is claimed is:

1. A method of determining a dish load in an automatic dishwasher comprising a tub for receiving dishes to be cleaned, a water inlet valve for introducing water into the tub, a spraying assembly for spraying the water throughout the tub to clean the dishes, a heating element for heating the water, a temperature sensor for sensing the temperature of the water, and a controller operably coupled to and for the controlling the operation of the water inlet valve, spray assembly, heating element, and temperature sensor to introduce water into the tub, spray the water, and drain the water to wash the dishes, the method comprising:

introducing a first charge of water into the tub;

spraying the first charge of water throughout the tub;

determining a first temperature corresponding to the temperature of the first charge of water when the temperature of the first charge of water and dishes are substantially equalized;

removing the first charge of water from the tub;

introducing a second charge of water into the tub;

determining a second temperature corresponding to the temperature of the second charge of water prior to a time when the second charge of water and dishes are substantially equalized;

spraying the second charge of water throughout the tub;

determining a third temperature corresponding to the temperature of the second charge of water when the temperature of the second charge of water and dishes are substantially equalized; and determining the dish load by calculating a temperature ratio of the difference between the second and third temperatures and the difference between the third and first temperatures.

2. The method of claim 1 and further comprising determining the second temperature after the initiation of the introduction of the second charge of water and prior to the time when the second charge of water contacts and transfers heat to the dishes.

3. The method of claim 2 and further comprising delaying the determination of the second temperature until the passage of a predetermined time after the initiation of the introduction of the second charge of water.

4. The method of claim 1 wherein the determination of the second temperature comprises setting the second temperature equal to the maximum temperature sensed by the sensor within a predetermined time after the initiation of the introduction of the second water charge.

5. The method of claim 1 wherein the step of determining the dish load further comprises comparing the temperature ratio to a predetermined threshold value and selecting a dish load based on the comparison.

6. The method of claim 5 wherein the step of selecting the dish load further comprises selecting the dish load from a group of dish load categories.

7. The method of claim 6 wherein the group of dish load categories includes at least a large load and small load category.

8. The method of claim 5 and further comprising selecting the predetermined threshold value based on at least one physical characteristic of the dishwasher.

9. The method of claim 8 wherein the at least one physical characteristic is the material from which the tub is made.

10. A method for cleaning dishes based on the dish load in an automatic dishwasher comprising a tub for receiving dishes to be cleaned, a water inlet valve for introducing water into the tub, a spraying assembly for spraying the water throughout the tub to clean the dishes, a heating element for heating the water, a temperature sensor for sensing the temperature of the water, and a programmable controller operably coupled to and for the controlling the operation of the water inlet valve, spray assembly, heating element, and temperature sensor to wash the dishes according to a wash cycle programmed into the controller with the wash cycle having operating parameters including the steps of the wash cycle and operating variables for the steps, the method comprising:

introducing a first charge of water into the tub;

spraying the first charge of water throughout the tub;

determining a first temperature corresponding to the temperature of the first charge of water when the temperature of the first charge of water and dishes are substantially equalized;

removing the first charge of water from the tub;

introducing a second charge of water into the tub;

determining a second temperature corresponding to the temperature of the second charge of water prior to a time when the second charge of water contacts and transfers heat to the dishes;

spraying the second charge of water throughout the tub;

determining a third temperature corresponding to the temperature of the second charge of water when the temperature of the second charge of water and dishes are substantially equalized;

determining a dish load by calculating a temperature ratio of the difference between the second and third temperatures and the difference between the third and first temperatures; and setting at least one operating parameter for the wash cycle based on the dish load.

11. The method according to claim 10 wherein the setting of the operating parameter comprises selecting a step for the wash cycle.

12. The method according to claim 11 wherein the step selection includes selecting at least one of a water fill step, a water spraying step, a water removing step, and a water heating step.

13. The method according to claim 12 wherein the setting of at least one parameter further comprises setting a variable for step.

14. The method according to claim 13 wherein the setting of the variable includes setting at least one of the duration and water temperature for the selected step.

15. The method according to claim 14 and further comprising determining a soil load and using the dish load and soil load to set the at least one operating parameter.

16. The method according to claim 15 and further comprising comparing the dish load and soil load to a predetermined threshold value and selecting the step and setting the variable based on the comparison.

17. The method according to claim 10 wherein the setting of at least one parameter comprises setting a variable for a step of the wash cycle.

18. The method according to claim 17 wherein the setting of the variable includes setting at least one of the duration and water temperature for the step of the wash cycle.

19. The method according to claim 17 wherein the setting of the operating parameter further comprises selecting a step for the wash cycle.

20. The method according to claim 19 wherein the step selection includes selecting at least one of a water fill step, a water spraying step, a water removing step, and a water heating step.

21. The method according to claim 10 and further comprising determining a soil load and using the dish load and soil load to set the at least one operating parameter.

22. The method according to claim 21 and further comprising comparing the dish load and soil load to a predetermined threshold value and selecting the step and setting the variable based on the comparison.

23. The method according to claim 22 wherein the setting of the at least one parameter comprises at least one of selecting a step for the wash cycle and setting a variable for a step of the wash cycle.

24. The method according to claim 10 and further comprising comparing the dish load to a predetermined threshold value and setting the operating parameter based on the comparison.

25. The method according to claim 24 wherein the setting of at least one parameter comprises at least one of selecting a step for the wash cycle and setting a variable for a step of the wash cycle based on the comparison.

26. A method for cleaning dishes based on the dish load in an automatic dishwasher comprising a tub for receiving dishes to be cleaned, a water inlet valve for introducing water into the tub, a spraying assembly for spraying water throughout the tub to clean the dishes, a heating element for heating the water, a temperature sensor for sensing the temperature of the water, and a programmable controller operably coupled to and for the controlling the operation of the water inlet valve, spray assembly, heating element, and temperature sensor to wash the dishes according to a wash cycle programmed into the controller with the wash cycle having operating parameters including the steps of the wash cycle and operating variables for the steps, the method comprising:

determining a first temperature corresponding to the temperature of the dishes;

determining a second temperature corresponding to the temperature of water in the tub;

determining a third temperature corresponding to the temperature of the dishes after the temperature of the water and dishes are substantially equalized in response to the spraying of the water throughout the tub;

determining a dish load by calculating a temperature ratio of the difference between the second and third temperatures and the difference between the third and first temperatures; and setting at least one operating parameter for the wash cycle based on the dish load.

27. The method according to claim 26 wherein the determining of the first temperature comprises:

introducing a first charge of water into the tub;

spraying the first charge of water throughout the tub; and determining the first temperature by measuring the temperature of the first charge of water when the temperature of the first charge of water and dishes are substantially equalized.

28. The method according to claim 27 further comprising:

introducing a second charge of water into the tub;

spraying the second charge of water throughout the tub; and determining the third temperature by measuring the temperature of the second charge of water when the temperature of the second charge of water and dishes are substantially equalized.

29. The method according to claim 28 wherein the determining of the second temperature comprises determining the water temperature of the second charge of water prior to a time when the second charge of water contacts and transfers heat to the dishes.

30. The method according to claim 26 wherein the setting of the operating parameter comprises selecting a step for the wash cycle.

31. The method according to claim 30 wherein the step selection includes selecting at least one of a water fill step, a water spraying step, a water removing step, and a water heating step.

32. The method according to claim 26 wherein the setting of at least one parameter further comprises setting a variable for a step in the wash cycle.

33. The method according to claim 32 wherein the setting of the variable includes setting at least one of the duration and water temperature for the step.

34. The method according to claim 26 and further comprising determining a soil load and using the dish load and soil load to set the at least one operating parameter.

35. The method according to claim 34 and further comprising comparing the dish load and soil load to a predetermined threshold value and setting the at least one parameter based on the comparison.

36. The method according to claim 35 wherein the setting of at least one parameter comprises setting a variable for a step of the wash cycle.

37. The method according to claim 35 wherein the setting of the variable includes setting at least one of the duration and water temperature for the step of the wash cycle.

38. The method according to claim 37 wherein the setting of the operating parameter further comprises selecting a step for the wash cycle.

39. The method according to claim 38 wherein the step selection includes selecting at least one of a water fill step, a water spraying step, a water removing step, and a water heating step.

* * * * *